US008763400B2

(12) United States Patent
Bunker

(10) Patent No.: US 8,763,400 B2
(45) Date of Patent: Jul. 1, 2014

(54) AERODYNAMIC PYLON FUEL INJECTOR SYSTEM FOR COMBUSTORS

(75) Inventor: Ronald Scott Bunker, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 901 days.

(21) Appl. No.: 12/535,313

(22) Filed: Aug. 4, 2009

(65) Prior Publication Data

US 2011/0030375 A1 Feb. 10, 2011

(51) Int. Cl.
*F02C 7/22* (2006.01)

(52) U.S. Cl.
USPC ..... 60/739; 60/740; 60/791

(58) Field of Classification Search
USPC ..... 60/39.17, 733, 739, 740, 742, 746, 747, 60/748, 791, 737, 761, 762, 763, 764, 765, 60/766
See application file for complete search history.

(56) References Cited

U.S. PATENT DOCUMENTS

| | | | | | |
|---|---|---|---|---|---|
| 2,970,438 | A | * | 2/1961 | Howald | 60/739 |
| 2,995,317 | A | | 8/1961 | Schoppe | |
| 3,008,669 | A | | 11/1961 | Tanczos et al. | |
| 3,386,249 | A | | 6/1968 | Dugger et al. | |
| 4,147,029 | A | | 4/1979 | Sargisson et al. | |
| 4,197,700 | A | * | 4/1980 | Jahnig | 60/774 |
| 4,206,593 | A | | 6/1980 | Su et al. | |
| 4,214,722 | A | * | 7/1980 | Tamura | 244/208 |
| 4,423,595 | A | | 1/1984 | McLean | |
| 4,887,425 | A | | 12/1989 | Vdoviak | |
| 4,893,468 | A | * | 1/1990 | Hines | 60/775 |
| 4,976,102 | A | | 12/1990 | Taylor | |
| 5,036,657 | A | * | 8/1991 | Seto et al. | 60/39.281 |
| 5,052,176 | A | * | 10/1991 | Labatut et al. | 60/225 |
| 5,099,644 | A | | 3/1992 | Sabla et al. | |
| 5,203,796 | A | * | 4/1993 | Washam et al. | 60/737 |
| 5,207,064 | A | * | 5/1993 | Ciokajlo et al. | 60/737 |
| 5,385,015 | A | * | 1/1995 | Clements et al. | 60/765 |
| 5,400,589 | A | | 3/1995 | Mahias et al. | |
| 5,437,159 | A | * | 8/1995 | Ansart et al. | 60/746 |
| 5,454,220 | A | | 10/1995 | Althaus et al. | |
| 5,577,378 | A | * | 11/1996 | Althaus et al. | 60/39.17 |

(Continued)

FOREIGN PATENT DOCUMENTS

| | | | |
|---|---|---|---|
| CN | 1764498 | A | 4/2006 |
| CN | 101196125 | A | 6/2008 |

(Continued)

OTHER PUBLICATIONS

Gruenig, Avrashkov & Mayinger; "Fuel Injection into a Supersonic Airflow by Means of Pylons";Journal of Propulsion and Power; vol. 16 No. 1 Jan.-Feb. 2000; pp. 29-34.

(Continued)

*Primary Examiner* — Gerald L Sung
*Assistant Examiner* — Michael B Mantyla
(74) *Attorney, Agent, or Firm* — Ann M. Agosti

(57) ABSTRACT

A combustor system includes a pylon fuel injection system coupled to a combustion chamber and configured to inject fuel to the combustion chamber. The pylon fuel injection system includes a plurality of radial elements, each radial element having a plurality of first Coanda type fuel injection slots. A plurality of transverse elements are provided to each radial element. Each transverse element includes a plurality of second Coanda type fuel injection slots.

14 Claims, 4 Drawing Sheets

(56) References Cited

U.S. PATENT DOCUMENTS

| | | | | |
|---|---|---|---|---|
| 5,647,200 | A * | 7/1997 | Althaus | 60/39.17 |
| 5,826,429 | A * | 10/1998 | Beebe et al. | 60/723 |
| 5,899,061 | A | 5/1999 | Bouchez et al. | |
| 5,927,067 | A * | 7/1999 | Hanloser et al. | 60/761 |
| 6,125,627 | A * | 10/2000 | Rice et al. | 60/765 |
| 6,202,399 | B1 | 3/2001 | Frutschi | |
| 6,260,349 | B1 * | 7/2001 | Griffiths | 60/39.17 |
| 6,295,801 | B1 * | 10/2001 | Burrus et al. | 60/776 |
| 6,564,555 | B2 * | 5/2003 | Rice et al. | 60/746 |
| 6,619,026 | B2 * | 9/2003 | Carelli et al. | 60/39.17 |
| 6,868,676 | B1 * | 3/2005 | Haynes | 60/776 |
| 6,983,601 | B2 * | 1/2006 | Koshoffer | 60/761 |
| 7,467,518 | B1 | 12/2008 | Vermeersch | |
| 7,832,212 | B2 | 11/2010 | Bunker | |
| 7,861,977 | B1 * | 1/2011 | Krol et al. | 244/207 |
| 8,192,688 | B2 * | 6/2012 | Hagen et al. | 422/129 |
| 2002/0174657 | A1 * | 11/2002 | Rice et al. | 60/746 |
| 2004/0219079 | A1 * | 11/2004 | Hagen et al. | 422/194 |
| 2007/0033945 | A1 * | 2/2007 | Goldmeer et al. | 60/774 |
| 2007/0107436 | A1 * | 5/2007 | Evulet | 60/776 |
| 2008/0060359 | A1 * | 3/2008 | Eadon et al. | 60/740 |
| 2008/0078182 | A1 * | 4/2008 | Evulet | 60/776 |
| 2008/0104961 | A1 | 5/2008 | Bunker | |
| 2008/0110173 | A1 * | 5/2008 | Bunker | 60/737 |
| 2008/0134685 | A1 * | 6/2008 | Bunker et al. | 60/776 |

FOREIGN PATENT DOCUMENTS

| | | | |
|---|---|---|---|
| CN | 101201176 | A | 6/2008 |
| EP | 0816664 | A1 | 1/1998 |
| JP | 58217725 | A | 12/1983 |
| JP | 1045927 | A | 2/1989 |
| JP | 029918 | A | 1/1990 |
| JP | 2016335 | A | 1/1990 |
| JP | 02130249 | A | 5/1990 |
| JP | 04251118 | A | 9/1992 |
| JP | 0579628 | A | 3/1993 |
| JP | 06193509 | A | 7/1994 |
| JP | 06323160 | A | 11/1994 |
| JP | 07248116 | A | 9/1995 |
| JP | 11236823 | A | 8/1999 |
| JP | 2007187150 | A | 7/2007 |

OTHER PUBLICATIONS

Lt. Daniel R. Montes, Paul I. King, Mark R. Gruber, Campbell D. Carter, and Kuang-Yu (Mark) Hsu; "Mixing Effects of Pylonaided Fuel Injection Located Upstream of a Flameholding Cavity in Supersonic Flow (Postprint)"; 41st AIAA/ASME/SAE/ASEE Joint Propulsion Conference & Exhibit Jul. 10-13, 2005, Tucson, Arizona; AFRL-PR-WP-TP-2006-247; 24Pages.

Mark R. Gruber and Campbell D. Carter, Daniel R. Montes, Lane C. Haubelt, and Paul I. King & Kuang-Yu Hsu; "Experimental Studies of Pylon-Aided Fuel Injection into a Supersonic Crossflow"; Journal of Propulsion and Power vol. 24, No. 3, May-Jun. 2008; 1 Page.

Unofficial English translation of Office Action issued in connection with corresponding CN Application No. 201010254583.2 on Nov. 4, 2013.

Unofficial English translation of Chinese Office Action issued in connection with corresponding CN Application No. 201010254583.2 on Mar. 13, 2014.

Doster et al., "Pylon Fuel Injector Design for a Scramjet Combustor", AIAA/ASME/SAE/ASEE Joint Propulsion Conference & Exhibit, pp. 1-16, Cincinnati, OH, Jul. 8-11, 2007.

Japanese Office Action issued in connection with corresponding JP Application No. 2010-168722 on Apr. 1, 2014.

* cited by examiner

AERODYNAMIC PYLON FUEL INJECTOR SYSTEM FOR COMBUSTORS

BACKGROUND

The invention relates generally to fuel injection systems, and more particularly to an aerodynamic pylon fuel injector system for a combustor, for example a reheat combustor.

A gas turbine system includes at least one compressor, a first combustion chamber located downstream of the at least one compressor and upstream of a first turbine, and a second combustion chamber (may also be referred to as "reheat combustor") located downstream of the first turbine and upstream of a second turbine. A mixture of compressed air and a fuel is ignited in the first combustion chamber to generate a working gas. The working gas flows through a transition section to a first turbine. The first turbine has a cross-sectional area that increases towards a downstream side. The first turbine includes a plurality of stationary vanes and rotating blades. The rotating blades are coupled to a shaft. As the working gas expands through the first turbine, the working gas causes the blades, and therefore the shaft, to rotate.

The power output of the first turbine is proportional to the temperature of the working gas in the first turbine. That is, the higher the temperature of the working gas, the greater the power output of the turbine assembly. To ensure that the working gas has energy to transfer to the rotating blades within the second turbine, the working gas must be at a high working temperature as the gas enters the second turbine. However, as the working gas flows from the first turbine to the second turbine, temperature of the working gas is reduced. Thus, the power output generated from the second turbine is less than optimal. The amount of power output from the second turbine could be increased if the temperature of the working gas within the second turbine is increased. The working gas is further combusted in the second combustion chamber so as to increase the temperature of the working gas in the second turbine.

In a conventional system, a gas turbine engine uses a second combustor in which a plurality of axially oriented cylindrical injectors are used to inject gaseous fuel and air. The conventional injection systems have a limited number of fuel injection locations or nozzles creating non-uniform distribution of fuel in the combustion chamber. As a result, related problems such as combustion dynamics due to non-uniform mixing of fuel and non-uniform heat release may occur. The conventional injection system also generates significant pressure drop within the combustion chamber.

There is a need for an improved fuel injection system for a combustor, particularly for a reheat combustor.

BRIEF DESCRIPTION

In accordance with one exemplary embodiment of the present invention, a combustor system includes a pylon fuel injection system coupled to a combustion chamber and configured to inject fuel to the combustion chamber. The pylon fuel injection system includes a plurality of radial elements, each radial element having a plurality of first Coanda type fuel injection slots. A plurality of transverse elements are provided to each radial element. Each transverse element includes a plurality of second Coanda type fuel injection slots.

In accordance with another exemplary embodiment of the present invention, a gas turbine system includes a first combustor coupled to the at least one compressor and configured to receive the compressed air from the compressor and a fuel and combust a mixture of the air and the fuel to generate a first combustion gas. A first turbine is coupled to the first combustor and configured to expand the first combustion gas. A second combustor is coupled to the first turbine. A pylon fuel injection system is configured to inject the fuel into the second combustor.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

In accordance with the embodiments discussed herein below, a combustor system is disclosed. The exemplary combustor system includes a pylon fuel injection system coupled to a combustion chamber and configured to inject fuel to the combustion chamber. The pylon fuel injection system includes a plurality of radial elements, each radial element having a plurality of first Coanda type fuel injection slots. A plurality of transverse elements are provided to each radial element. Each transverse element includes a plurality of second Coanda type fuel injection slots. In accordance with another exemplary embodiment of the present invention, a gas turbine system having an exemplary pylon fuel injection system is disclosed. The pylon injection systems have a larger number of fuel injection locations creating uniform distribution of fuel in the combustion chamber. Related problems such as combustion dynamics, non-uniform mixing of fuel, and pressure drop within the combustion chamber are mitigated.

Figure 1:
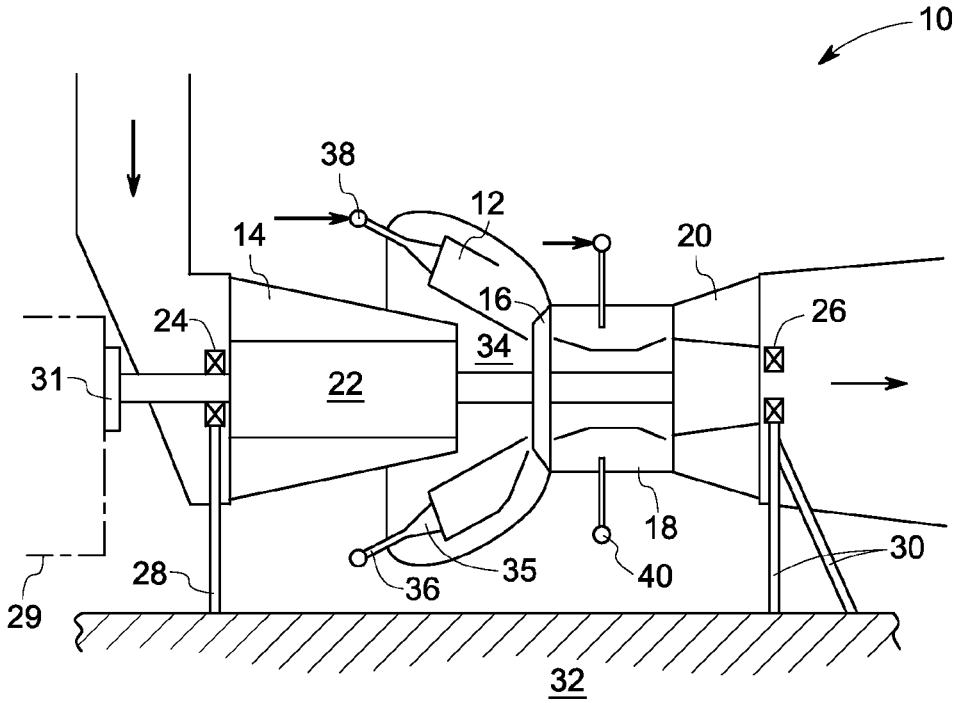
FIG. 1 is a diagrammatical representation of a gas turbine system having a pylon fuel injection system provided to a reheat combustor in accordance with an exemplary embodiment of the present invention.

Referring to FIG. 1, an exemplary combustor system, for example, a gas turbine system 10 is disclosed. It should be noted herein that the configuration of the illustrated gas turbine system 10 is an exemplary embodiment and should not be construed as limiting. The configuration may vary depending on the application. The gas turbine system 10 includes a first combustion chamber 12 (may also be referred to as "first combustor") disposed downstream of a compressor 14. A first turbine 16 is disposed downstream of the first combustion chamber 12. A second combustion chamber 18 (may also be referred to as "reheat combustor") is disposed downstream of the first turbine 16. A second turbine 20 is disposed downstream of the second combustion chamber 18. The compressor 14, the first turbine 16, and the second turbine 20 have a single rotor shaft 22. It should be noted herein that provision of a single rotor shaft should not be construed as limiting. In another embodiment, the second turbine 20 may have a separate drive shaft. In the illustrated embodiment, the rotor shaft 22 is supported by two bearings 24, 26 disposed at a front end of the compressor 14 and downstream of the second turbine 20. The bearings 24, 26 are mounted respectively on anchor units 28, 30 coupled to a foundation 32. The rotor shaft 22 is coupled to a generator 29 via a coupling 31.

The compressor stage can be subdivided into two partial compressors (not shown) in order, for example, to increase the specific power depending on the operational layout. The induced air after compression flows into a casing 34 disposed enclosing an outlet of the compressor 14 and the first turbine 16. The first combustion chamber 12 is accommodated in the casing 34. The first combustion chamber 12 has a plurality of burners 35 distributed on a periphery at a front end and configured to maintain generation of a hot gas. Fuel lances 36 coupled together through a main ring 38 are used to provide fuel supply to the first combustion chamber 12. The hot gas (first combustion gas) from the first combustion chamber 12 act on the first turbine 16 immediately downstream, resulting in thermal expansion of the hot gases. The partially expanded hot gases from the first turbine 16 flow directly into the second combustion chamber 18.

The second combustion chamber 18 may have different geometries. In the illustrated embodiment, the second combustion chamber 18 is an aerodynamic path between the first turbine 16 and the second turbine 20 having required length and volume to allow reheat combustion. In the illustrated embodiment, a pylon fuel injection system 40 is disposed radially in the second combustion chamber 18. The pylon fuel injection system 40 is configured to inject a fuel into the exhaust gas from the first turbine 16 so as to ensure self-ignition of the exhaust gas in the second combustion chamber 18. The details of the pylon fuel injection system 40 are explained with reference to subsequent embodiments. A hot gas (second combustion gas) generated from the second combustion chamber 18 is subsequently fed to a second turbine 20. The hot gas from the second combustion chamber 18 act on the second turbine 20 immediately downstream, resulting in thermal expansion of the hot gases. It should be noted herein that even though the pylon fuel injection system 40 is explained with reference to a reheat combustor, the exemplary system 40 could be applied for any combustors.

Figure 2:
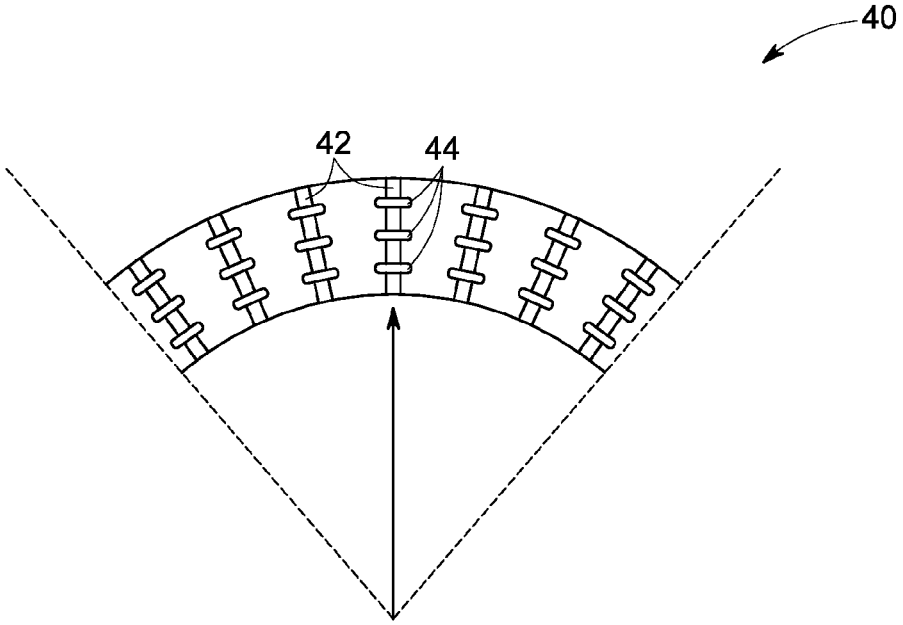
FIG. 2 is a diagrammatical representation of a pylon fuel injection system in accordance with an exemplary embodiment of the present invention.

Referring to FIG. 2, the pylon fuel injection system 40 is disclosed. As discussed previously, the pylon fuel injection system 40 is disposed radially within the second combustion chamber or reheat combustor and configured to inject fuel into the second combustion chamber. The system 40 includes a plurality of radial elements 42 spaced apart from each other. A plurality of transverse elements 44 are provided to each radial element 42. The transverse elements 44 are also spaced apart from each other on the corresponding radial element 42. Both the radial and transverse elements 42, 44 have a plurality of Coanda type fuel injection slots (not shown in FIG. 2) configured to inject fuel into the second combustion chamber. The arrangement of the pylon fuel injection system 40 with multiple Coanda type fuel injection locations allows for radial and circumferential distribution of fuel so as to enable a uniform distribution and mixing of fuel within the combustion chamber.

Figure 3:
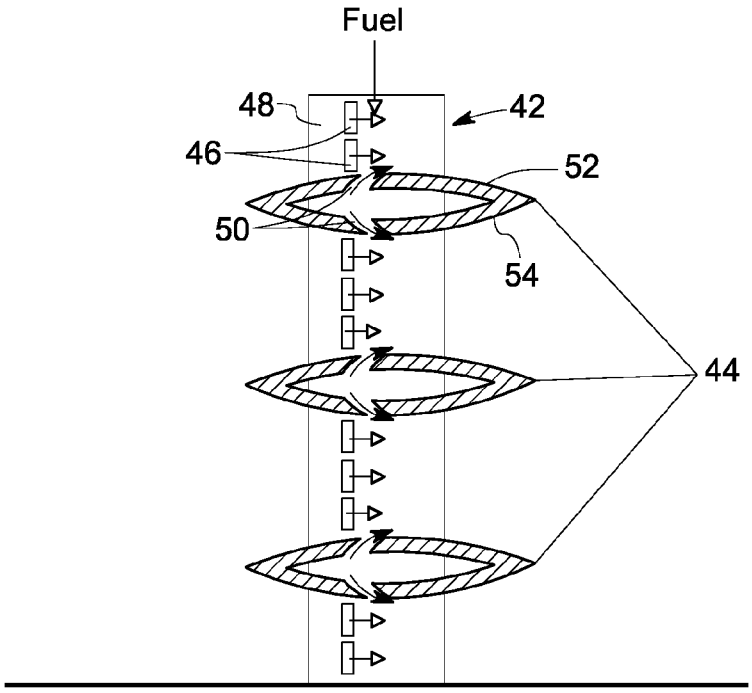
FIG. 3 is a diagrammatical representation of a portion of a pylon fuel injection system in accordance with an exemplary embodiment of the present invention.

Referring to FIG. 3, a portion of the pylon fuel injection system is disclosed. In the illustrated embodiment, a plurality of transverse elements 44 are disposed spaced apart from each other on a corresponding radial element 42. It should be noted herein the transverse elements 44 are aerodynamically shaped. The radial element 42 includes a plurality of Coanda type fuel injection slots 46 formed on at least one surface 48. Each transverse element 44 includes a plurality of Coanda type fuel injection slots 50 formed on surfaces 52, 54. The arrangement of radial elements 42 and the transverse elements 44 facilitates uniform distribution and mixing of fuel in the combustion chamber and also ensures characteristic mixing length associated with the Coanda type injection process to be of the same order as the length scale created by the spacing between the radial elements 42 and the transverse elements 44. It should be noted herein that a "slot" discussed herein may be usually broadly defined as an opening that has one axis longer than another axis. In certain embodiments, the radial and transverse elements 42, 44 may include conical holes, elliptic holes, racetrack shaped holes, round holes, or combinations thereof to provide a Coanda effect. It should be noted herein that the shape or cross-sectional size of the radial elements 42 may change as a function of radius, and that the shape or relative size of the transverse elements 44 may change as a function of location.

Figure 4:
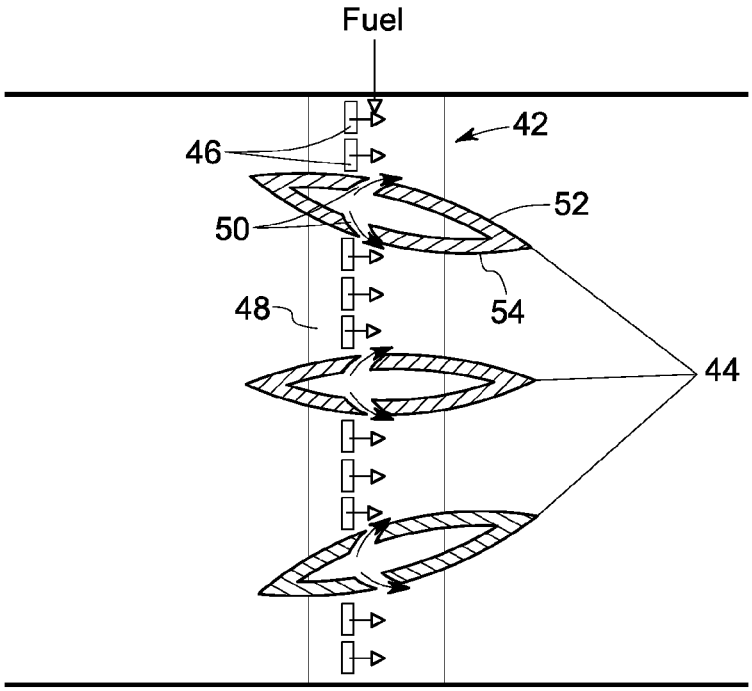
FIG. 4 is a diagrammatical representation of a portion of a pylon fuel injection system in accordance with an exemplary embodiment of the present invention.

Referring to FIG. 4, a portion of the pylon fuel injection system is disclosed. This embodiment is similar to the embodiment illustrated in FIG. 3. It should be noted herein that the radial element 42 is aerodynamically shaped. In some embodiments, the transverse elements 44 include zero lift airfoils. In certain other embodiments, the transverse elements 44 have lift capability. In a particular embodiment, the lift of the transverse elements 44 may act in concert. In another embodiment, the lift of the transverse elements 44 may be counter-acting against each other to tailor exit profile of the flow of gas in the combustion chamber. In certain embodiments, the radial elements 42 have lift capability. In one embodiment, the radial elements 42 may act as de-swirlers to remove swirl from an upstream gas flow from the first turbine. In another embodiment, the radial elements 42 may act as pre-swirlers for providing swirl to the downstream flow fed to the second turbine. It should also be noted that provision of the transverse elements 44 facilitates to provide a plurality of distributed locations for fuel injection.

Figure 5:
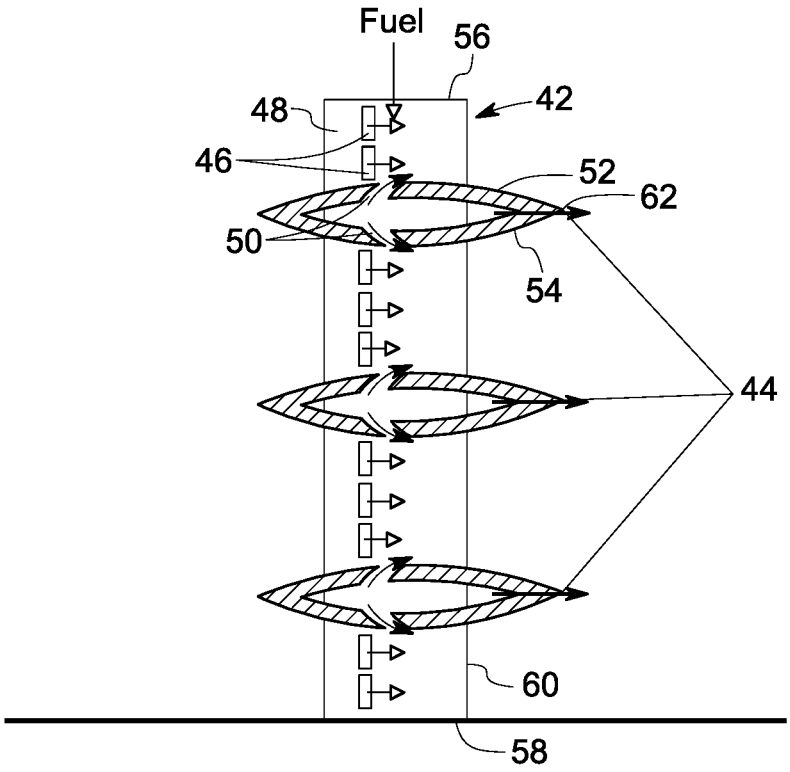
FIG. 5 is a diagrammatical representation of a portion of a pylon fuel injection system in accordance with an exemplary embodiment of the present invention.

Referring to FIG. 5, a portion of the pylon fuel injection system is disclosed. This embodiment is also similar to the embodiment illustrated in FIG. 3. As discussed previously, a plurality of transverse elements 44 are disposed spaced apart from each other on each corresponding radial element 42. The radial element 42 includes a plurality of Coanda type fuel injection slots 46 formed on at least one surface 48. Additionally, slots 46 may also be formed on side surfaces 56, 58 of each radial element 42. A rear surface 60 of the radial element 42 may have holes or openings. Each transverse element 44 includes a plurality of Coanda type fuel injection slots 50 formed on surfaces 52, 54. Additionally, slots 50 may also be formed on a trailing edge 62 of each transverse element 44.

It should be noted herein that in certain embodiments, the distributed nature of the plurality of radial elements 42 with the corresponding transverse elements 44 may allow staging of the fuel injection (for example, only injecting fuel at a particular instant from alternate radial elements) for the purpose of load reduction. The radial height of the radial elements 42 may also vary. For example, every alternate radial element may be shorter than the other radial elements.

Figure 6:
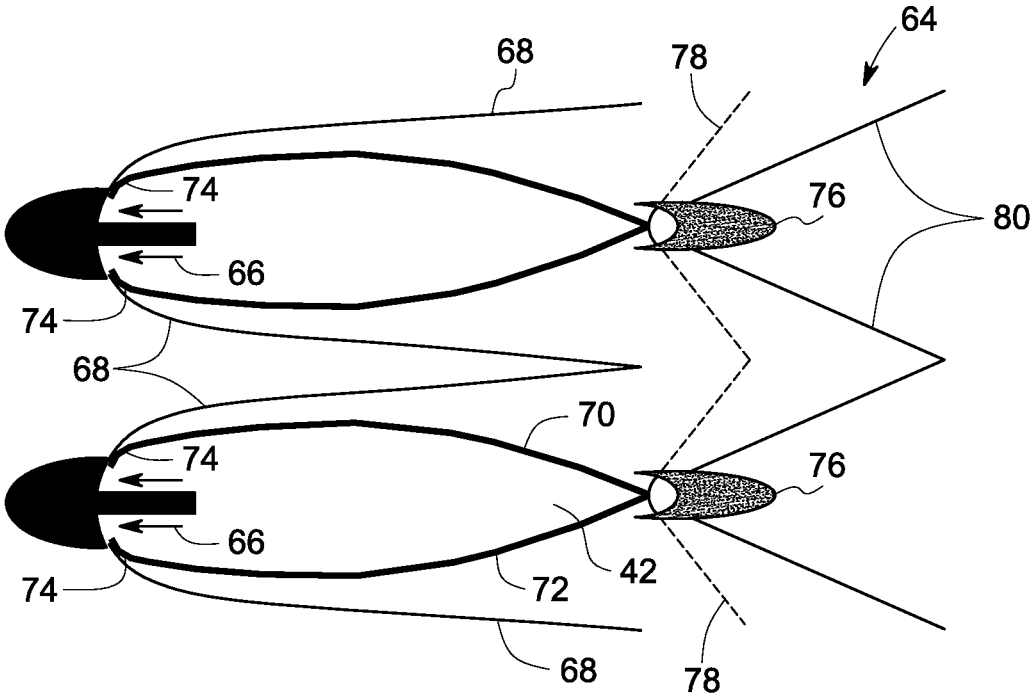
FIG. 6 is a diagrammatical illustration of the formation of a fuel layer adjacent a profile in a Coanda type fuel injection slot based upon a coanda effect in accordance with an exemplary embodiment of the present invention.

FIG. 6 is a schematic of an exemplary reaction zone that may be established downstream of the radial element 42. As used herein, the term "Coanda effect" refers to the tendency of a stream of fluid to attach itself to a nearby surface and to remain attached even when the surface curves away from the original direction of fluid motion. As illustrated, compressor discharge air flowing over a tandem vane mix with a fuel 66. As a result, air and fuel mixture boundary layers 68 are formed along external surfaces 70, 72 of the radial element 42 by the Coanda effect created by the Coanda surfaces 74. Triple flames 64 may be formed as the concentration of fuel and air varies locally downstream of the trailing edge of the radial element 42. In a fuel rich region, small diffusion flame front pockets 76 are stabilized. Then, each diffusion flame may serve to stabilize a first lean partially premixed flame 78 at a minimum flammability limit and a second lean partially premixed flame front 80 formed of diluted products of the other two flames 76 and 78 and excess oxidizer. Such a flame structure and its advantages are explained in detail in patent application Ser. No. 11/567,796 titled "Gas turbine guide vanes with Tandem airfoils and fuel injection and method of use" incorporated herein by reference.

With reference to embodiments of FIGS. 1-6, the number of radial elements, transverse elements, spacing between the radial elements, spacing between the transverse elements, number of Coanda type fuel injection slots in the radial elements, number of Coanda type fuel injection slots in the transverse elements, shape of the Coanda type fuel injection slots in the radial and transverse elements, spacing between the Coanda type fuel injection slots, dimensions of the slots, location of the slots in the radial and transverse elements, shape of the radial elements and transverse elements may be varied depending on the application. All such permutations and combinations are envisaged. The exemplary pylon fuel injection system facilitates uniform distribution of fuel, uniform mixing of air and fuel, leading to high combustion efficiency with lower emissions, acoustics, and pressure loss.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A combustor system comprising:

a combustion chamber upstream of a turbine;

a pylon fuel injection system coupled to the combustion chamber and configured to inject fuel to the combustion chamber, the pylon fuel injection system comprising:

a plurality of radial elements, each radial element comprising a plurality of first Coanda type fuel injection slots configured to induce a Coanda Effect of the fuel along an external surface of the radial element body; and a plurality of transverse elements provided to each radial element, each transverse element comprising a plurality of second Coanda type fuel injection slots configured to induce a Coanda Effect of the fuel along an external surface of the transverse element body;

wherein each of the first and second Coanda type fuel injection slots comprises an upstream and downstream curved surface, wherein the downstream surface of each fuel injection slot and an adjacent external surface of the corresponding element are continuous and form a curved trajectory to allow a Coanda Effect of the fuel along the corresponding external surface.

2. The pylon fuel injection system of claim 1, wherein the plurality of radial elements are disposed spaced apart from each other.

3. The pylon fuel injection system of claim 1, wherein each radial element comprises a plurality of Coanda type fuel injection slots on at least one surface of the corresponding radial element.

4. The pylon fuel injection system of claim 1, wherein each transverse element comprises a plurality of Coanda type fuel injection slots on at least one surface of the corresponding transverse element.

5. The pylon fuel injection system of claim 1, wherein the plurality of transverse elements are disposed spaced apart from each other on the corresponding radial element.

6. The pylon fuel injection system of claim 1, wherein the plurality of radial elements are aerodynamically shaped.

7. The pylon fuel injection system of claim 1, wherein the plurality of transverse elements are aerodynamically shaped.

8. The pylon fuel injection system of claim 1, wherein the plurality of radial and transverse elements are configured to provide staged fuel injection.

9. A gas turbine system comprising:

at least one compressor configured to generate compressed air, a first combustor coupled to the at least one compressor and configured to receive the compressed air from the compressor and a fuel and combust a mixture of the air and the fuel to generate a first combustion gas;

a first turbine coupled to the first combustor and configured to expand the first combustion gas;

a second combustor coupled to the first turbine, wherein the second combustor is upstream of a second turbine;

a pylon fuel injection system comprising a plurality of radial elements and a plurality of transverse elements provided to each radial element, wherein each radial element and transverse element comprises a plurality of Coanda type fuel injection slots configured to induce a Coanda Effect of the fuel along an external surface of the respective radial element body or transverse element body, wherein each of the first and second Coanda type fuel injection slots comprises an upstream and downstream curved surface, wherein the downstream surface of each fuel injection slot and an adjacent external surface of the respective radial element body or transverse element body are continuous and form a curved trajectory to allow a Coanda Effect of the fuel along the external surface, wherein the pylon injection system is configured to inject the fuel to the second combustor; wherein the second combustor is configured to combust a mixture of the fuel and the expanded first combustion gas to generate a second combustion gas;

a second turbine coupled to the second combustor and configured to expand the second combustion gas.

10. The gas turbine system of claim 9, wherein the plurality of radial elements are disposed spaced apart from each other.

11. The gas turbine system of claim 9, wherein the plurality of transverse elements are disposed spaced apart from each other on the corresponding radial element.

12. The gas turbine system of claim 9, wherein the plurality of radial elements are aerodynamically shaped.

13. The gas turbine system of claim 9, wherein the plurality of transverse elements are aerodynamically shaped.

14. The gas turbine system of claim 9, wherein the plurality of radial and transverse elements are configured to provide staged fuel injection.

* * * * *